US011511894B2

(12) United States Patent
Hempe et al.

(10) Patent No.: US 11,511,894 B2
(45) Date of Patent: Nov. 29, 2022

(54) CABLE TIE APPLICATION TOOL

(71) Applicant: HellermannTyton Corporation, Milwaukee, WI (US)

(72) Inventors: David A. Hempe, Menomonee Falls, WI (US); Roger D. Neitzell, Pewaukee, WI (US); Peter David Joseph, Mukwonago, WI (US); Blaine G. Kuehmichel, Wausau, WI (US); Jonathan Paul Loeck, Sherwood, WI (US); Nicholas Alexander Matiash, Oshkosh, WI (US)

(73) Assignee: HellermannTyton Corporation, Milwaukee, WI (US)

( * ) Notice: Subject to any disclaimer, the term of this patent is extended or adjusted under 35 U.S.C. 154(b) by 0 days.

(21) Appl. No.: 17/009,628

(22) Filed: Sep. 1, 2020

(65) Prior Publication Data

US 2021/0094713 A1 Apr. 1, 2021

Related U.S. Application Data

(60) Provisional application No. 62/906,293, filed on Sep. 26, 2019.

(51) Int. Cl.
*B65B 13/02* (2006.01)
*B26D 7/14* (2006.01)
(Continued)

(52) U.S. Cl.
CPC ..... *B65B 13/027* (2013.01); *B26D 7/14* (2013.01)

(58) Field of Classification Search
CPC ..... B65B 13/027; B65B 13/22; B65B 13/187; B65B 61/06; B26D 7/14
(Continued)

(56) References Cited

U.S. PATENT DOCUMENTS 3,865,156 A * 2/1975 Moody ..... B65B 13/027 140/93.2
4,371,010 A * 2/1983 Hidassy ..... B65B 13/027 140/93.2
(Continued)

FOREIGN PATENT DOCUMENTS

CN 1100054 3/1995
CN 1572657 2/2005
(Continued)

OTHER PUBLICATIONS

Pawl Mechanism, retrieved date Nov. 19, 2021.*
(Continued)

*Primary Examiner* — Adam J Eiseman
*Assistant Examiner* — Mohammed S. Alawadi
(74) *Attorney, Agent, or Firm* — Colby Nipper PLLC

(57) ABSTRACT

A cable tie application tool is described that includes an electro-mechanical tensioning system. When the electro-mechanical tensioning system is controlled by a processor to tighten a cable, a reactionary force through a drive nut that is pivotally mounted to a tension bar can be monitored and measured by a strain gauge, a load cell, or other sensing system. This reactionary force is an indication of tension on the cable tie and is monitored by the processor until the tension reaches a predetermined tension, at which point, the processor causes a motor in the tensioning system to stop increasing the tension on the cable tie. The processor activates a cut-off system to cut the cable tie that has been tightened to the predetermined tension.

25 Claims, 8 Drawing Sheets

(51) Int. Cl.
*B65B 13/22* (2006.01)
*B65B 13/18* (2006.01)
*B65B 61/06* (2006.01)

(58) Field of Classification Search
USPC ..... 140/57, 93.2, 123.5, 123.6
See application file for complete search history.

(56) References Cited

U.S. PATENT DOCUMENTS

| | | | | |
|---|---|---|---|---|
| 4,495,972 | A * | 1/1985 | Walker | B65B 13/027 140/93.2 |
| 4,534,817 | A * | 8/1985 | O'Sullivan | B29C 65/78 156/352 |
| 4,790,225 | A * | 12/1988 | Moody | B65B 13/027 206/346 |
| 4,793,385 | A | 12/1988 | Dyer et al. | |
| D306,390 | S | 3/1990 | Dyer | |
| 4,997,011 | A | 3/1991 | Dyer et al. | |
| 5,205,328 | A * | 4/1993 | Johnson | B65B 13/027 140/93.2 |
| 5,287,802 | A | 2/1994 | Pearson | |
| 5,492,156 | A | 2/1996 | Dyer et al. | |
| 5,595,220 | A * | 1/1997 | Leban | B65B 13/027 140/93.2 |
| 5,769,133 | A * | 6/1998 | Dyer | B65B 13/027 140/93.2 |
| 5,809,873 | A | 9/1998 | Chak et al. | |
| 5,909,751 | A * | 6/1999 | Teagno | B65B 13/027 140/93.2 |
| 5,915,425 | A * | 6/1999 | Nilsson | B65B 13/027 140/93.2 |
| 5,921,290 | A | 7/1999 | Dyer et al. | |
| 6,206,053 | B1 * | 3/2001 | Hillegonds | B65B 13/027 140/93.2 |
| 6,302,157 | B1 | 10/2001 | Deschenes et al. | |
| 6,354,336 | B1 * | 3/2002 | Leban | B65B 13/027 140/93.2 |
| 6,401,766 | B1 | 6/2002 | Ishikawa | |
| 6,497,258 | B1 * | 12/2002 | Flannery | B65D 63/1063 140/93.2 |
| 6,543,341 | B2 | 4/2003 | Lopez | |
| 6,751,828 | B2 | 6/2004 | Matschiner et al. | |
| 7,124,787 | B2 * | 10/2006 | Lueschen | B65B 13/027 140/93.2 |
| 7,165,379 | B1 | 1/2007 | Lai | |
| 7,210,506 | B2 * | 5/2007 | Magno, Jr. | B23Q 17/00 140/93.2 |
| D543,811 | S | 6/2007 | Lueschen | |
| D547,626 | S | 7/2007 | Lueschen et al. | |
| 7,591,451 | B2 | 9/2009 | Dyer et al. | |
| 8,240,343 | B2 | 8/2012 | Dyer et al. | |
| D692,738 | S | 11/2013 | Dyer | |
| 8,955,556 | B2 | 2/2015 | Myers et al. | |
| 8,960,241 | B2 | 2/2015 | Dyer | |
| D732,361 | S | 6/2015 | Dyer | |
| D755,029 | S | 5/2016 | Myers et al. | |
| 9,394,067 | B2 | 7/2016 | Dyer | |
| 9,394,068 | B2 | 7/2016 | Dyer | |
| 9,481,102 | B1 | 11/2016 | Hojnacki et al. | |
| 9,550,590 | B2 | 1/2017 | Dyer | |
| 9,694,924 | B2 | 7/2017 | Myers et al. | |
| D818,787 | S | 5/2018 | Kitago | |
| D856,101 | S | 8/2019 | Kitago | |
| D878,177 | S | 3/2020 | Kitago | |
| 11,008,123 | B2 | 5/2021 | Kitago | |
| 11,008,124 | B2 | 5/2021 | Kitago | |
| 11,027,902 | B2 | 6/2021 | Geiger et al. | |
| 2002/0093211 | A1 | 7/2002 | Filipiak et al. | |
| 2002/0108664 | A1 | 8/2002 | Kurmis | |
| 2002/0108666 | A1 | 8/2002 | Kurmis | |
| 2002/0108667 | A1 | 8/2002 | Thieme | |
| 2002/0108668 | A1 | 8/2002 | Thieme | |
| 2002/0129866 | A1 * | 9/2002 | Czebatul | B65B 13/027 140/123.6 |
| 2003/0136278 | A1 | 7/2003 | Miyazaki et al. | |
| 2004/0244606 | A1 | 12/2004 | Haberstroh et al. | |
| 2004/0244866 | A1 | 12/2004 | Ishikawa et al. | |
| 2005/0178460 | A1 * | 8/2005 | Magno, Jr. | B23Q 17/00 140/123.6 |
| 2005/0178461 | A1 * | 8/2005 | Magno, Jr. | B65B 13/027 140/123.6 |
| 2006/0011254 | A1 | 1/2006 | Yokochi et al. | |
| 2006/0037661 | A1 | 2/2006 | Lueschen | |
| 2007/0157555 | A1 | 7/2007 | Tanner | |
| 2007/0199610 | A1 | 8/2007 | Itagaki | |
| 2009/0121069 | A1 | 5/2009 | Dyer et al. | |
| 2013/0167969 | A1 | 7/2013 | Myers et al. | |
| 2013/0167970 | A1 | 7/2013 | Dyer | |
| 2015/0053300 | A1 | 2/2015 | Myers et al. | |
| 2015/0151862 | A1 | 6/2015 | Kitago | |
| 2015/0239588 | A1 | 8/2015 | Kitago | |
| 2016/0016682 | A1 | 1/2016 | Boss et al. | |
| 2016/0046398 | A1 | 2/2016 | Neeser et al. | |
| 2016/0075456 | A1 | 3/2016 | Nomura et al. | |
| 2016/0167813 | A1 | 6/2016 | Myers | |
| 2016/0230907 | A1 | 8/2016 | Kitago | |
| 2016/0280405 | A1 | 9/2016 | Thieme et al. | |
| 2017/0057674 | A1 | 3/2017 | Myers | |
| 2017/0174374 | A1 | 6/2017 | Figiel et al. | |
| 2019/0106231 | A1 | 4/2019 | Schwinn et al. | |
| 2019/0144149 | A1 | 5/2019 | Dohrmann et al. | |

FOREIGN PATENT DOCUMENTS

| | | |
|---|---|---|
| CN | 1660675 | 8/2005 |
| CN | 101486385 | 7/2009 |
| CN | 101585419 | 11/2009 |
| CN | 101983159 | 3/2011 |
| CN | 102859821 | 1/2013 |
| CN | 202670128 | 1/2013 |
| CN | 104870315 | 8/2015 |
| CN | 206579887 | 10/2017 |
| CN | 108791998 | 11/2018 |
| DE | 69728071 | 2/2005 |
| DE | 102014103334 | 9/2015 |
| EP | 0722885 | 7/1996 |
| EP | 0839717 | 5/1998 |
| EP | 1564146 | 8/2005 |
| EP | 3068693 | 1/2019 |
| JP | H09240617 | 9/1997 |
| JP | 2000103407 | 4/2000 |
| WO | 9815458 | 4/1998 |
| WO | 2009152707 | 12/2009 |
| WO | 2015067444 | 5/2015 |

OTHER PUBLICATIONS

"Foreign Office Action", CN Application No. 201811344796.7, dated Jan. 26, 2021, 7 pages.
"Foreign Office Action", CN Application No. 201811167015.1, dated Dec. 11, 2020, 14 pages.
"Partial European Search Report", EP Application No. 20198300.4, dated Feb. 18, 2021, 12 pages.
Pishehvari, et al., "Ego-pose estimation via Radar and Openstreetmap-based Scan matching", May 2018, 8 pages.
"Extended European Search Report", EP Application No. 18192166.9, dated Jan. 15, 2019, 5 pages.
"Foreign Office Action", CN Application No. 201811167015.1, dated Apr. 24, 2020, 18 pages.
"Foreign Office Action", CN Application No. 201811344796.7, dated Jun. 28, 2020, 17 pages.
"Non-Final Office Action", Application No., dated May 27, 2020, 13 pages.
"Non-Final Office Action", U.S. Appl. No. 16/163,677, dated Jun. 1, 2020, 14 pages.
"Extended European Search Report", EP Application No. 20198300.4, dated May 20, 2021, 11 pages.
"Foreign Office Action", CN Application No. 201811167015.1, dated Jun. 2, 2021, 7 pages.

(56) References Cited

OTHER PUBLICATIONS

"Autotool 2000 CPK Operating Instructions", Hellerman Tyton, 106-29006, Apr. 2, 2015, 29 pages.
"Final Office Action", U.S. Appl. No. 16/120,926, dated Nov. 15, 2021, 18 pages.
"Foreign Office Action", CN Application No. 202011032227.6, dated Dec. 16, 2021, 23 pages.
"Non-Final Office Action", U.S. Appl. No. 16/163,677, dated Dec. 7, 2021, 19 pages.
"Foreign Office Action", CN Application No. 202011032227.6, dated Jun. 7, 2022, 58 pages.
"Non-Final Office Action", U.S. Appl. No. 16/163,677, dated Jun. 10, 2022, 15 pages.
Hellermantyton, "EVO 7 Series & 7i Series Nosepiece, 1/Pkg", Retrieved at: https://www.hellermanntyton.us/products/110-70011/—on Mar. 30, 2022, 1 page.
Hellermantyton, "EVO 7 Series & 7i Series Nosepiece, 1mm tail, 1/pkg", Retrieved at: https://www.hellermanntyton.us/products/110-70131/—on Mar. 30, 2022, 1 page.
Hellermantyton, "EVO 7 Series & 7i Series Nosepiece, 2mm tail, 1/pkg", Retrieved at: https://www.hellermanntyton.us/products/110-70132/—on Mar. 30, 2022, 1 page.
Hellermantyton, "EVO 7 Series & 7i Series Nosepiece, 3mm tail, 1/pkg", Retrieved at: https://www.hellermanntyton.us/products/110-70133/—on Mar. 30, 2022, 1 page.
Hellermantyton, "EVO 9 and EVO 9i 2mm Nosepiece, Extended Tail, 1/pkg", Retrieved at: https://www.hellermanntyton.us/products/110-80064/—on Mar. 30, 2022, 1 page.
Hellermantyton, "EVO 9 and EVO 9i 3mm Nosepiece, Extended Tail, 1/pkg", Retrieved at: https://www.hellermanntyton.us/products/110-80065/—on Mar. 30, 2022, 1 page.
Hellermantyton, "EVO 9 and EVO 9i 4mm Nosepiece, Extended Tail, 1/pkg", Retrieved at: https://www.hellermanntyton.us/products/110-80066/—on Mar. 30, 2022, 1 page.
Hellermantyton, "EVO 9 and EVO 9i 5mm Nosepiece, Extended Tail, 1/pkg", Retrieved at: https://www.hellermanntyton.us/products/110-80067/—on Mar. 30, 2022, 1 page.
Hellermantyton, "EVO 9 Nosepiece Flush Cut, Replacement Part, 1/pkg", Retrieved at: https://www.hellermanntyton.us/products/110-80018/—on Mar. 30, 2022, 1 page.
"Final Office Action", U.S. Appl. No. 16/120,926, dated Feb. 17, 2022, 13 pages.
"Notice of Allowance", U.S. Appl. No. 16/163,677, dated Aug. 25, 2022, 11 pages.

* cited by examiner

CABLE TIE APPLICATION TOOL

CROSS-REFERENCE TO RELATED APPLICATION

This application claims the benefit of U.S. Provisional Application No. 62/906,293 filed Sep. 26, 2019, the disclosure of which is hereby incorporated by reference in its entirety herein.

BACKGROUND

Cable ties are commonly used in wire-management applications (e.g., keeping wires in their proper locations, bundling groups of wires together). Typically, a cable tie can be looped around multiple wires, then tightened to cinch the wires together. The tail of the cable tie is then cut using a cutting tool (e.g., a wire cutter). The cable tie can be tightened or loosened to achieve a tension level that provides appropriate rigidity or flexibility. Whether this is done with the aid of a tool or by hand, maintaining a consistent tension can be very difficult. Tools, for example, can provide inconsistent tensioning of cable ties due to lifetime wear. A more-specialized solution to provide consistent tension to cable ties can enable precise cable tie tensioning for wire-management and other applications.

SUMMARY

This document describes a cable tie application tool. In one example, a cable tie application tool includes a housing, a power-delivery system included in the housing, an electro-mechanical tensioning system driven by the power-delivery system, a sensing system configured to sense a particular amount of force with which a cable tie is tightened by the electro-mechanical tensioning system, and a cut-off system configured to cut the cable tie after the cable tie is tightened by the electro-mechanical tensioning system.

In another example, a method includes driving, with a power-delivery system included in a housing of a cable tie application tool, an electro-mechanical tensioning system of the cable tie application tool to grab and tighten a cable tie. The method further includes sensing a particular amount of force with which the cable tie is tightened by the electro-mechanical tensioning system, then activating a cut-off system of the cable tie application tool to cut the cable tie when the particular amount of force satisfies a predetermined setting.

This document also describes means for performing the above-summarized method and other methods set forth herein, in addition to describing methods performed by the above-summarized systems and methods performed by other systems set forth herein.

This summary introduces simplified concepts of a cable tie application tool, which are further described below in the Detailed Description and Drawings. This summary is not intended to identify essential features of the claimed subject matter, nor is it intended for use in determining the scope of the claimed subject matter.

BRIEF DESCRIPTION OF THE DRAWINGS

The details of one or more aspects of a cable tie application tool are described in this document with reference to the following drawings. The same numbers are used throughout multiple drawings to reference like features and components.

DETAILED DESCRIPTION

Figure 1:
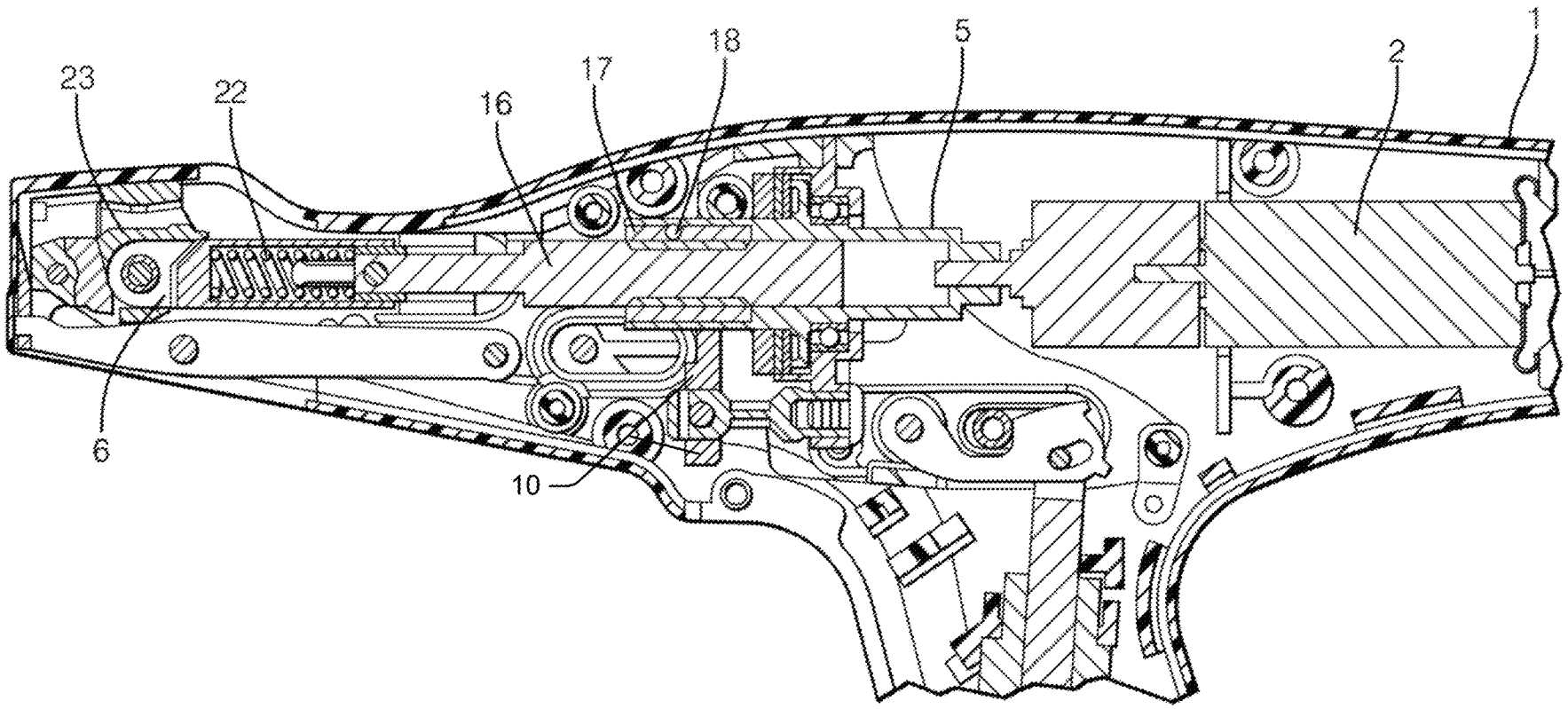
FIGS. 1 and 2 are cross-sectional views of an example cable tie application tool.

Cable ties are commonly used in wire-management applications (e.g., keeping wires in their proper locations, bundling groups of wires together). Typically, a cable tie can be looped around multiple wires, then tightened to cinch the wires together. The cable tie can be tightened or loosened to achieve a tension level that provides appropriate rigidity or flexibility.

Cable ties are currently applied using various methods. When done by hand, obtaining a consistent tension is very difficult, and the tail of the cable tie is then cut using another tool (e.g., a wire cutter). Certain tools are available that provide some degree of tensioning consistency and will typically cut the cable tie tail flush to the head. These tools are currently available and utilize various power-provision schemes that are hand-operated, pneumatic-controlled, electric-powered, and battery-powered. The tensioning control of these tools can depend on the type of power that is used and the product manufacturer, though most use a mechanical means for this function.

Mechanical tension-control systems, however, are inherently inconsistent over the life of the tool due to the natural wear of various components. Consequently, the tension supplied from a new tool will be different than that of a used tool. In addition, hand-operated versions will be inherently less ergonomic than powered systems due to the need to manually supply the force to tension and cut the cable ties.

Feedback systems (e.g., current feedback) of electric-powered tools have attempted to mitigate the tension-variation problems discussed above. However, wear will also affect the current in electric-powered tools, making them less consistent over time. Therefore, electric-powered tools do not satisfactorily address the above-mentioned issues.

A cable tie application tool is described that includes an electro-mechanical tensioning system. When the electro-mechanical tensioning system is controlled by a processor to tighten a cable, a reactionary force through a drive nut that is pivotally mounted to a tension bar can be monitored and measured by a strain gauge, a load cell, or another sensing system. This reactionary force is an indication of tension on the cable tie and is monitored by the processor until the tension reaches a predetermined threshold, at which point the processor causes a motor in the tensioning system to stop increasing the tension on the cable tie. The processor then activates a cut-off system to cut the cable tie that has been tightened to the predetermined tension.

There are two primary differences between prior tools and the example cable tie application tool presented herein. The first is the method of detecting tension. Prior cable tie application tools primarily utilize mechanical, spring-balance systems, which are connected to the member that is pulling on or tightening the cable tie, typically called a "pawl link" or a "pawl." If a spring balance is used, it is connected between this pawl and the primary loading system, which is a finger or hand trigger in manual tools. As the trigger is pulled, the force generated is transmitted through the spring-balance system and into the pawl. As the tension in the cable tie builds, resistance to additional movement is generated, which affects the spring balance. Once a desired tension is achieved, the spring balance will decouple from the trigger, thereby activating a cut-off mechanism. A problem with this style of system is that wear to the components can occur, causing fatigue in the springs. The combination of these issues causes the tension trip-point to vary over the life of the product. As mentioned in the description above, the cable tie application tool presented herein eliminates these wear and fatigue issues and therefore delivers consistent tensioning to a cable tie over the life of the cable tie application tool.

Figure 2:
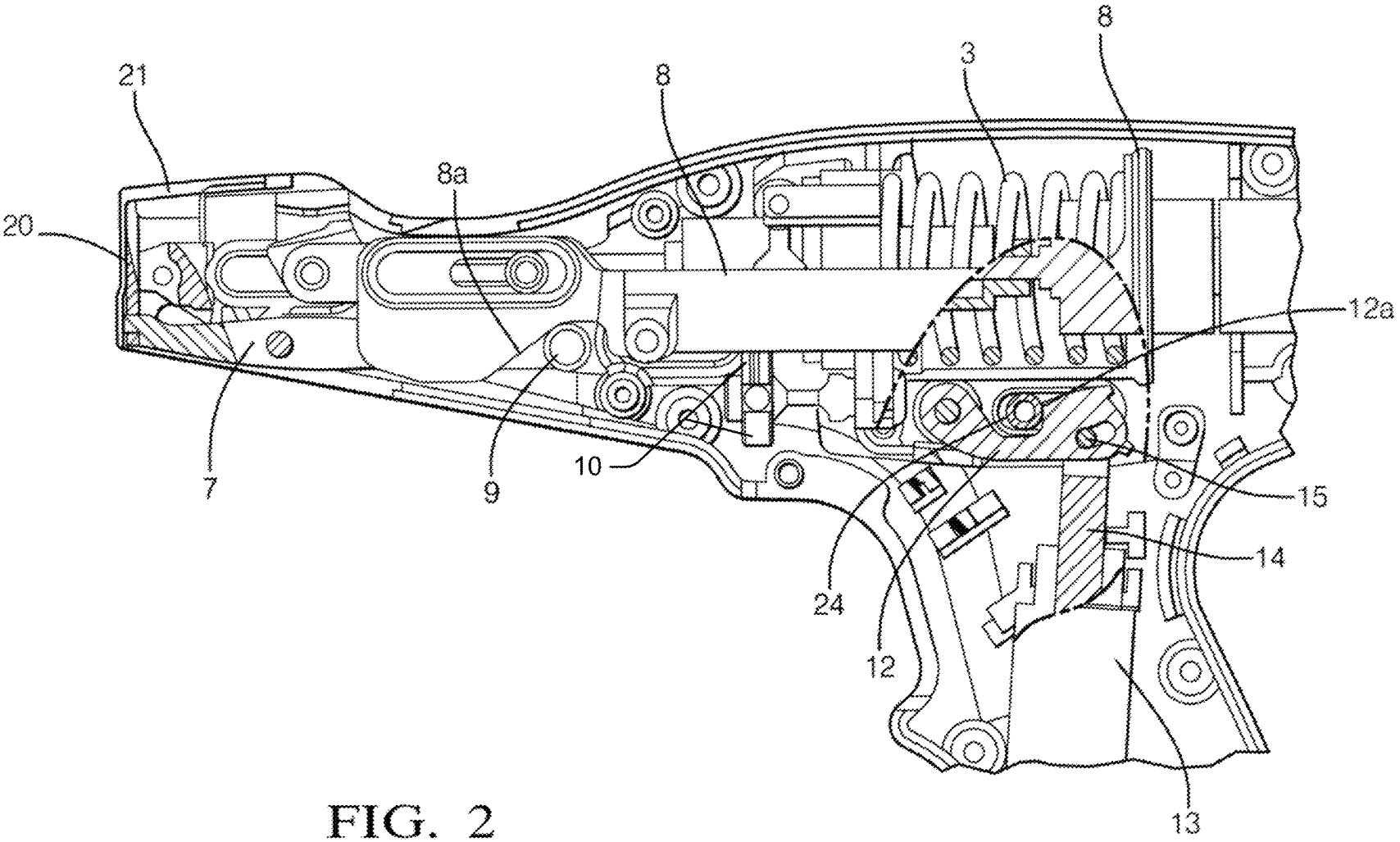

FIGS. 1 and 2 are a cross-section view of an example cable tie application tool. The cable tie application tool presented herein includes a housing 1 (e.g., a full or partial housing, a skeleton), a power-delivery system included in the housing 1 and including an electric motor 2, and an electro-mechanical tensioning system driven by the power delivery system and including a drive tube 5 and a pawl assembly including a pawl 6. The cable tie application tool further includes a sensing system configured to sense a particular amount of force with which a cable tie is tightened by the electro-mechanical tensioning system and a cut-off system configured to cut the cable tie after the cable tie is tightened by the electro-mechanical tensioning system. The cable tie application tool is an electro-mechanical system, and the electrical and mechanical components work in conjunction with each other.

The power-delivery system, including the electric motor 2, is integrated into the cable tie application tool and connected to a battery or an external power source. The electric motor 2 can be a brushless motor. In the illustrated example, electrical power is supplied via a battery contained within the cable tie application tool and connected to the electric motor 2. In other examples, the cable tie application tool is powered by an external electrical power source.

The electric motor 2 is directly connected to the drive tube 5. Therefore, when the electric motor 2 is activated, it will cause the drive tube 5 to rotate. The drive tube 5, being directly connected to the electrical motor 2, allows this rotation to occur in either direction, clockwise or counterclockwise. The electric motor 2 may be configured to rotate the drive tube when activated. Once activated, the electric motor 2 is configured to rotate the drive tube 5 in either a clockwise direction or a counterclockwise direction.

The electro-mechanical tensioning system further includes a drive nut 17 located at a forward end of the drive tube 5 and configured to rotate with the drive tube 5. With the drive nut 17 located at the forward end of the drive tube 5, the drive nut 17 is secured within the drive tube 5 by an alignment pin 18; the alignment pin 18 is configured to secure the drive nut 17 to the forward end of the drive tube 5, and therefore the rotation of the drive tube 5 will result in rotation of the drive nut 17.

The pawl assembly of the electro-mechanical tensioning system is connected to a reciprocating screw 16, including threads configured to engage with threads of the drive nut 17 to prevent rotation of the pawl assembly. The drive nut 17 engages the reciprocating screw 16, which is threaded through the drive nut 17. The reciprocating screw 16 is connected to the pawl assembly so as to prevent rotation of these components. The reciprocating screw 16 is configured to generate a reactionary force upon the drive nut 17 due to increases in the particular amount of force.

As the drive nut 17 rotates, an axial movement of the reciprocating screw 16 results from this arrangement. The reciprocating screw 16 is configured to generate an axial movement of the pawl assembly based on the rotation of the drive nut 17. The axial movement includes a forward motion of the pawl assembly based on a forward rotation of the drive nut 17. The axial movement includes a rearward motion of the pawl assembly based on a reverse rotation of the drive nut 17, where the reverse rotation is in an opposite direction as the forward rotation of the drive nut 17. That is, rotation in one direction will result in the forward motion of the pawl assembly, and reverse rotation will result in the rearward motion of this assembly.

The pawl assembly includes the pawl 6, a gripper 23 attached to the pawl 6, a torsional spring, and a gripper shaft configured to rotate around the torsional spring to cause the gripper 23 to rotate into engagement with a cable tie. The gripper 23 may be rotatably attached to the pawl 6.

The pawl assembly further includes a compression spring 22 configured to bias (e.g., forward-bias, reverse-bias) the pawl assembly from the reciprocating screw. As the pawl assembly moves rearward from its starting position, the gripper 23 is free to rotate towards the cable tie to engage and begin pulling or tightening the cable tie in this direction. The gripper 23 is configured to rotate to engage with the cable tie and pull the cable tie towards the pawl assembly or tighten with a particular amount of force.

For example, as the cable tie tightens around a wire bundle, the force applied to tighten or pull the cable tie increases. This force generates a reactionary force between the reciprocating screw 16 and the drive nut 17. The reciprocating screw 16 is configured to generate a reactionary force upon the drive nut 17 as the particular amount of force increases.

The reciprocating screw 16 may be further configured to move in a rearward direction to generate the reactionary force upon the drive nut 17. That is, during the tightening process, the reciprocating screw 16 is moving in the rearward direction, and the reactionary force generated from the screw 16 against the drive nut 17 will, therefore, be directed in the forward direction.

Figure 3:
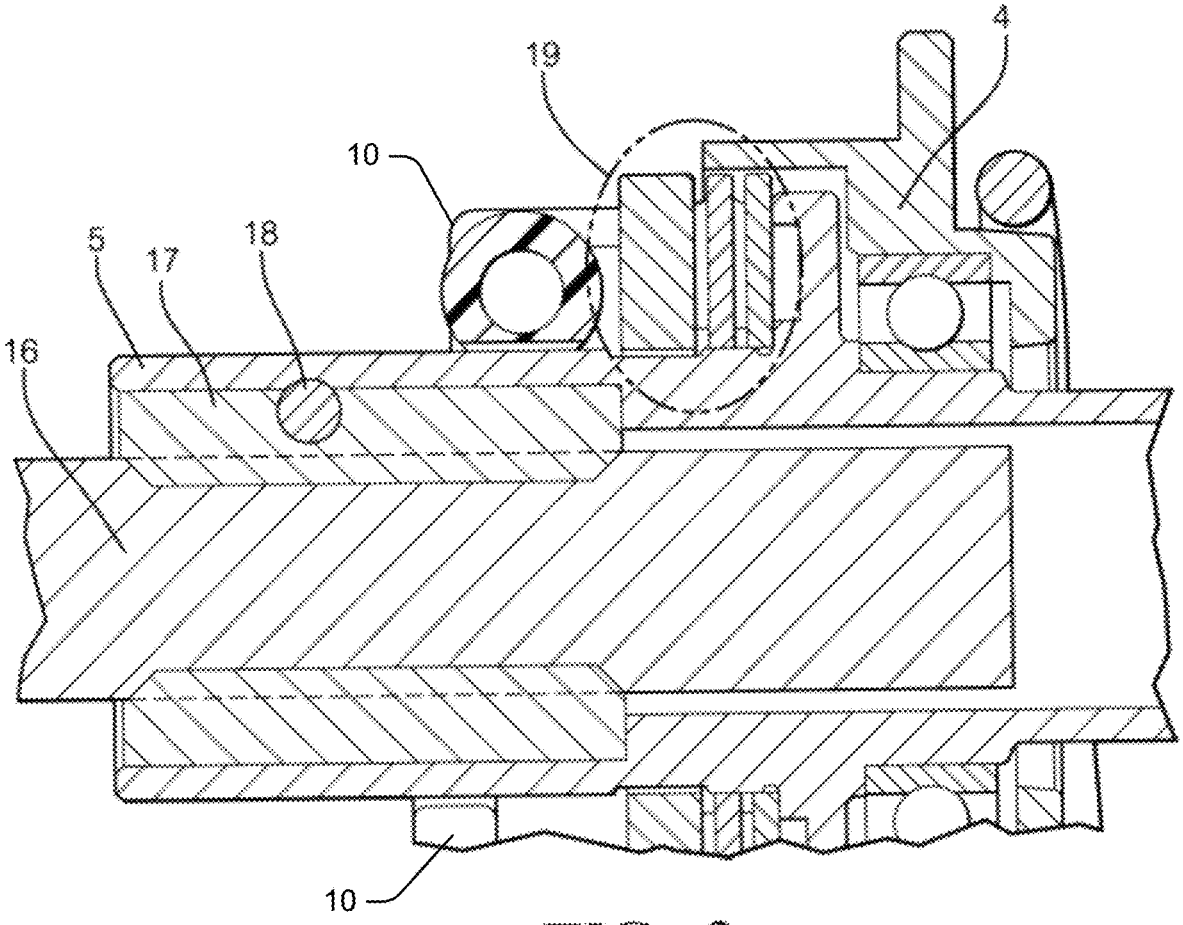
FIG. 3 is a close-up cross-section view of an electro-mechanical tensioning system of the cable tie application tool of FIGS. 1 and 2.

FIG. 3 is another cross-section view of the cable tie application tool of FIG. 1. This reactionary force being generated by the reciprocating screw 16 is translated through the drive tube 5, through a thrust-washer assembly 19, and into a lever 10. The drive tube 5 is configured to create a moment upon the lever 10 by translating the reactionary force through the thrust-washer assembly 19 and into the lever 10. The moment is created upon this lever 10 because one end of the lever 10 is pivotably attached to a skeleton 4 of the cable tie application tool, which is directly secured to the housing 1, and the other end of the lever 10 is connected to a tension rod 11 of the cable tie application tool.

Figure 4:
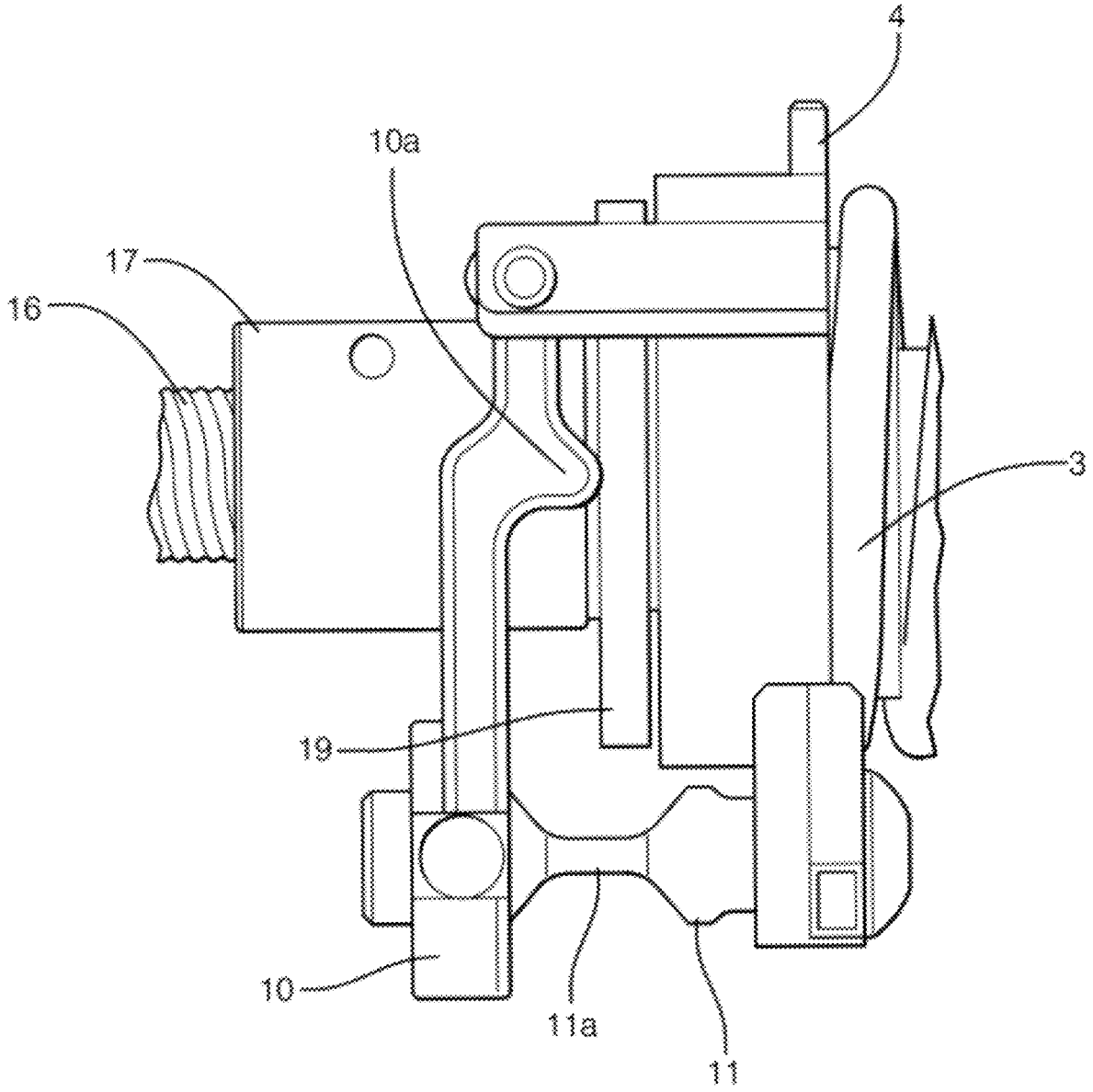
FIG. 4 is a side view of a component of the electro-mechanical tensioning system of FIG. 3.

FIG. 4 is a side view of the electro-mechanical tensioning system of FIG. 3. As shown in greater detail in FIG. 4, the drive tube 5 can be configured to create the moment upon the lever 10 by translating the reactionary force through the tension rod 11 in a forward direction opposite the rearward direction. The moment described above creates a force on the tension rod 11 acting in the forward direction. The tension rod 11 can be configured to distribute the reactionary force throughout a central portion 11A of the tension rod 11. The design of the tension rod 11 may be such that this reactionary force will be equally distributed throughout the central portion 11A of the tension rod 11.

Figure 5:
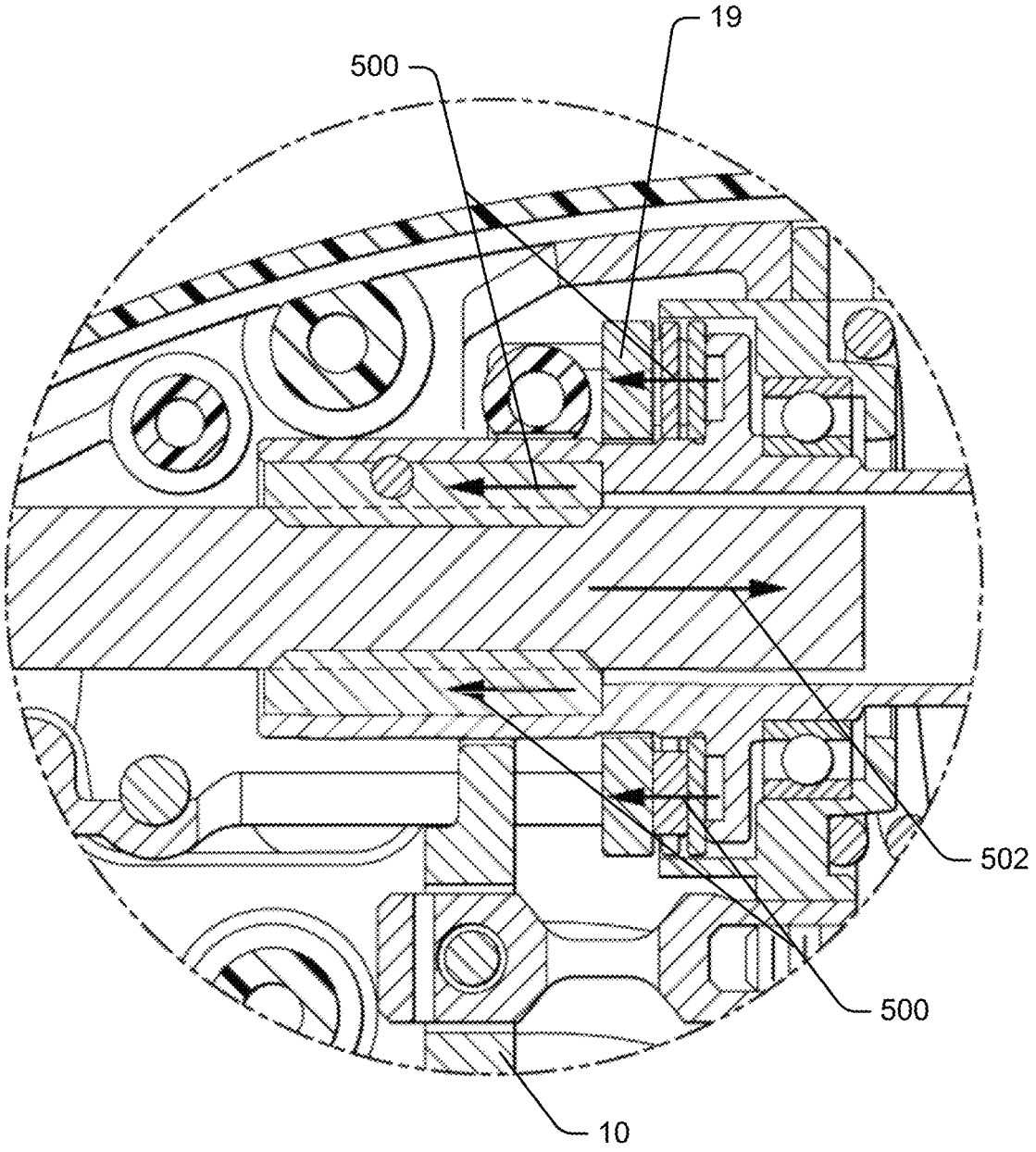
FIG. 5 is another cross-section view of the cable tie application tool of FIGS. 1 and 2 illustrating forces applied by the electro-mechanical tensioning system.
Figure 6:
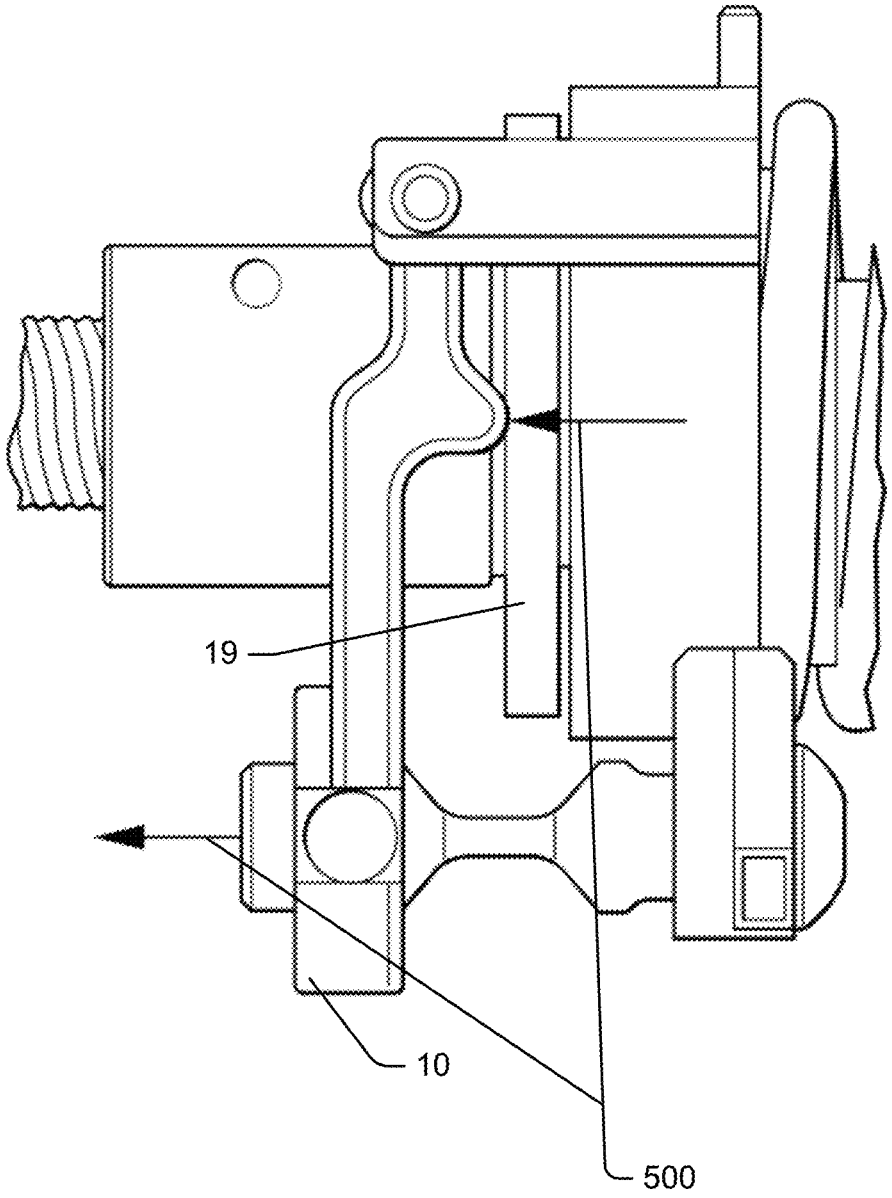
FIG. 6 is a side view of the component of the electro-mechanical tensioning system of FIG. 4 illustrating forces applied by the electro-mechanical tensioning system.

FIG. 5 is another cross-section view of the cable tie application tool of FIGS. 1 and 2. FIG. 6 is another side view of the electro-mechanical tensioning system of FIG. 4. Forces applied by the electro-mechanical tensioning system are illustrated in each of FIGS. 5 and 6. For example, FIG. 5 illustrates a reactionary force 500 placed on the lever 10, which is countered by a particular amount of force 502, corresponding to how tightly the electro-mechanical tensioning system pulls or tightens a cable tie, for example, when tightening around a bundle of wires. Also shown in FIG. 5 is how the reactionary force 500 translated through the thrust-washer assembly 19 is forced upon the lever 10. It is this same reactionary force 500 that counters the force 502 with which the electro-mechanical tensioning system pulls or tightens a cable tie.

Although not shown, the cable tie application tool includes a processor, a controller, or other logic that activates the cut-off system, which by returning to FIG. 2, is shown as including a cut-off spring 3 and an actuator 8. The actuator 8 is configured to be in a loaded condition before the processor activates the cut-off system. The actuator 8 is configured to compress the cut-off spring 3 when the actuator 8 is in the loaded condition by applying a rearward pressure. In addition, a cut-off camshaft 12 of the cut-off system is shown in FIG. 2. The cut-off camshaft 12 is fully engaged with an actuator bearing 24, which is supported within the actuator 8; this arrangement locks the cut-off system in a loaded state.

The cut-off system of the cable tie application tool can include a solenoid 13. The solenoid 13 is configured to energize when the cut-off system is activated by the processor. The solenoid 13 is configured to free the actuator 8 to move rearward to the cut-off spring 3 and into the loaded condition. When the cut-off system is activated, the solenoid 13 energizes, pulling a solenoid shaft 14 into the solenoid 13. The solenoid shaft 14 may be anchored by an anchor pin 15 to the cut-off camshaft 12. The solenoid shaft 14 pulls the cut-off camshaft 12 downwards, freeing the actuator 8 to move rearward based on pressure from the cut-off spring 3.

The cut-off system further includes a blade 20 connected to the actuator 8 and configured to cut a cable tie when the actuator 8 moves rearward into the loaded condition. In some examples, the cut-off system further includes a roller 9 configured to traverse down an actuator ramp 8A when the actuator 8 moves rearward into the loaded condition. This has the effect of rotating a link 7 between the actuator 8 and the blade 20, thereby cutting the cable tie. The rearward movement of the actuator 8 may cause the roller 9 to roll down the actuator ramp 8A, resulting in a rotation of the link 7. This rotation results in the upward movement of the blade 20, thereby cutting the cable tie.

In some examples, the cut-off system includes a motor and a camshaft that replace the solenoid 13 and the actuator 8. A second electric motor is configured to free the actuator 8 to move rearward to the cut-off spring 3 and into the loaded condition. Once the particular tension on a cable tie is achieved, the motor in the electro-mechanical tensioning system is stopped, and the motor in the cut-off system is activated. This second motor drives the link 7, causing the blade 20 to cut the cable tie.

Figure 7:
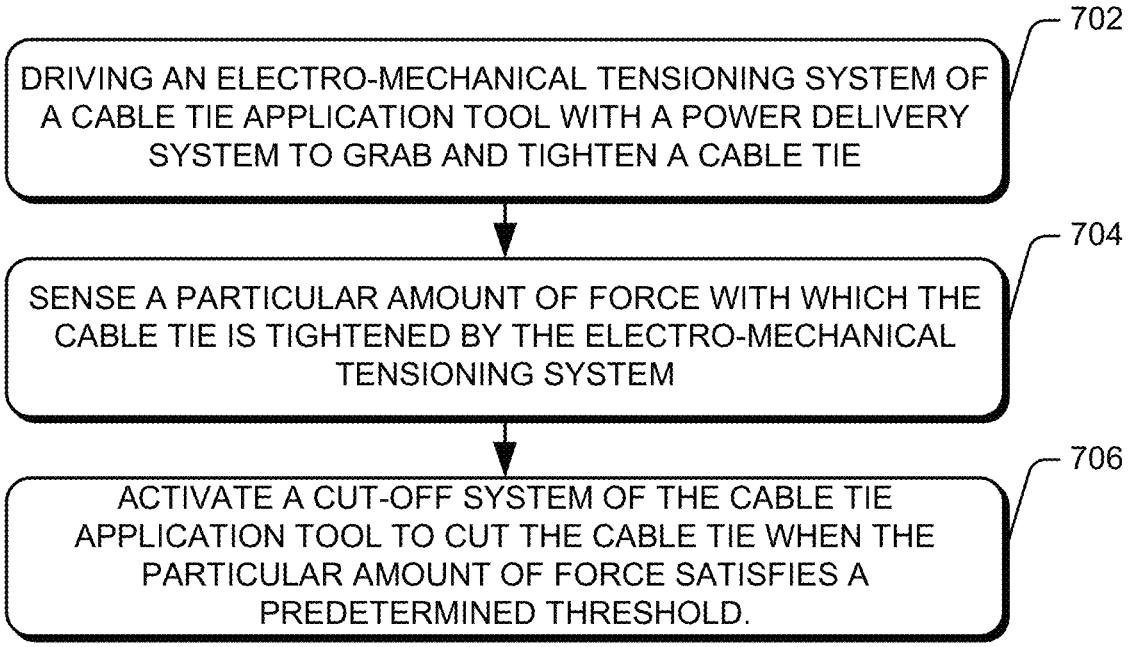
FIG. 7 is a flow-chart illustrating operations performed by an example cable tie application tool.

FIG. 7 is a flow-chart illustrating operations 700 performed by an example cable tie application tool. FIG. 7 is described in relation to the various examples of a cable tie application tool described above in relation to the other drawings, and reference may be made to various elements shown in FIGS. 1-6.

At 702, a cable tie application tool drives an electro-mechanical tensioning system with a power-delivery system to grab and tighten a cable tie. For example, the processor of the cable tie application tool may be configured to activate the electric motor 2 of the power-delivery system when the particular amount of force does not satisfy a preselected tension setting.

At 704, the cable tie application tool senses a particular amount of force with which the cable tie is tightened by the electro-mechanical tensioning system. The cable tie application tool precisely controls the electro-mechanical tensioning system. To do so, the electro-mechanical tensioning system can utilize a "homing" proximity sensor while also monitoring pulses supplied to and from the electric motor 2. For example, the power delivery system may include a proximity sensor configured to monitor a relative movement of a component of the cable tie application tool to determine the reactionary force. The proximity sensor may monitor the relative movement by measuring a level of rotation of an armature of the electric motor 2, for example, by counting pulses to and from the electric motor 2. That is, the pulse sent to and from the electric motor 2 indicates a level of rotation of an armature of the electric motor 2 and can be directly related to the distance traveled by the electro-mechanical tensioning system.

Additional proximity sensors may be used to monitor positions of various other components within the assembly. The relative movement can be for any component where its distance-traveled during activation of the electro-mechanical tensioning system is proportional to an amount of tension on a cable tie being tightened by the electro-mechanical tensioning system. While this is a viable option, proximity sensors are typically less accurate than the pulse counting.

At 706, the cable tie application tool activates a cut-off system to cut the cable tie when the particular amount of force satisfies a predetermined setting. For example, the processor of the cable tie application tool may be configured to deactivate the electric motor 2 of the power delivery system when the particular amount of force satisfies the preselected tension setting. The processor may be further configured to activate the cut-off system when the particular amount of force satisfies the preselected tension setting.

Figure 8:
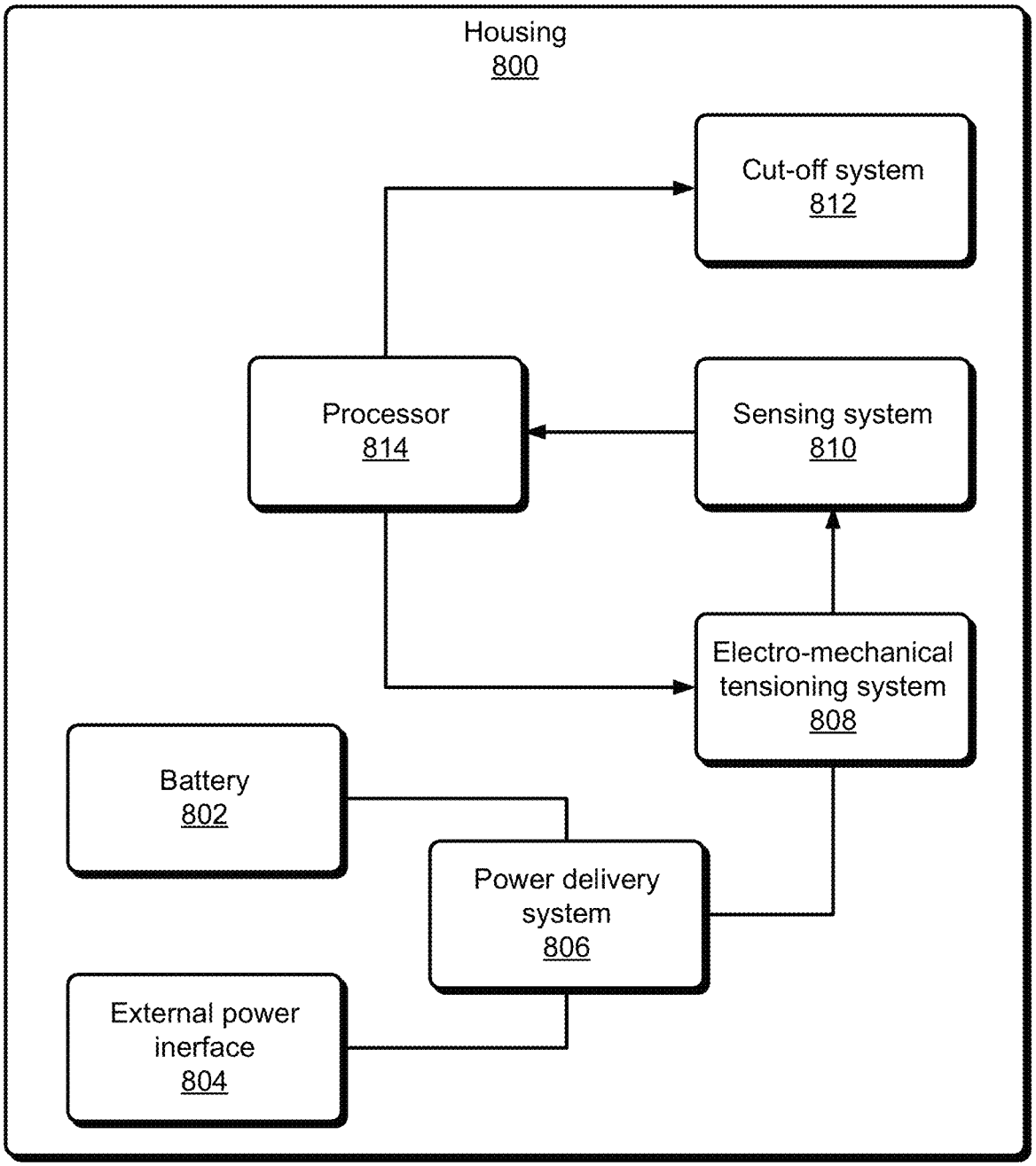
FIG. 8 is a block diagram illustrating a processor-based architecture of an example cable tie application tool.

FIG. 8 is a block diagram illustrating a processor-based architecture of an example cable tie application tool 800. The cable tie application tool includes a battery, an external power interface 804, a power delivery system 806, an electro-mechanical tensioning system 808, a sensing system 810, a cut-off system 812, and a processor 814.

The processor 814 is configured to determine, based on a reactionary force measured at the central portion 11A of the tension rod 11, the particular amount of force with which the electro-mechanical tension assembly pullsor tightens the cable tie. For example, the sensing system 810 can include strain gauges placed in the central portion 11A of the tension rod 11 to measure the reaction force and, therefore, the amount of tension that is tightening or pulling a cable tie tight during the operation of the cable tie application tool 800. If string gauges are used, the drive nut 17 is pivotally mounted to the tension rod 11. The processor 814, therefore, may be configured to determine the reactionary force using the one or more strain gauges. The sensing system 810 may include one or more load cells that are configured to measure the reactionary force, and the processor 814 may be configured to determine the reactionary force using the one or more load cells. In such a configuration, the reaction force is directed to the load cells rather than the tension rod 11 (which, in the case of load cells, can be omitted from the cable tie application tool entirely), and the signal from the load cell is sent to the processor 814.

The processor 814 can receive information from the gauges and compare the information to a predetermined tension setting that was preprogrammed into the processor 814 or stored in an internal memory or other non-tangible computer-readable storage medium operationally coupled to the processor 814 and inside the housing of the cable tie application tool 800. To avoid having to calibrate the cable tie application tool 800 during manufacturing or after prolonged use, a difference logic may be used to determine whether a cable tie is tightened to a predetermined tension. The processor 814 is configured to determine the reactionary force as a difference in pressure from when the actuator 8 is in an unloaded condition to when the actuator 8 moves into the loaded condition. The processor 814 can monitor an unloaded measurement taken by the sensing system 810 and then compare the unloaded measurement against the reactionary force and tension placed on the cable tie. A difference between the two values provides an indication of a true amount of tension applied to the cable tie. An advantage in utilizing the difference is calibration can be eliminated.

Once the electro-mechanical tensioning system 808 achieves the predetermined tension setting or another threshold, the processor 814 deactivates the electro-mechanical tensioning system 808 by shutting down the electric motor 2. Afterward, the processor activates the cut-off system 812.

In this way, the cable tie application tool 800 does not suffer similar drawbacks that other cable tie application tools have over the life of the tool. Specifically, the problem of tension variation over the life of the tool is solved by the cable tie application tool 800 measuring the reaction force created from tightening the cable tie and utilizing the measurement of this force to activate the cut-off system 812. This is a more direct measure of the tension on the cable tie, which will not vary, even if components of the cable tie application tool 800 wear from prolonged use.

In the following section, additional examples are provided.

Example 1. A cable tie application tool comprising: a housing; a power delivery system included in the housing; an electro-mechanical tensioning system driven by the power delivery system; a sensing system configured to sense a particular amount of force with which a cable tie is tightened by the electro-mechanical tensioning system; and a cut-off system configured to cut the cable tie after the cable tie is tightened by the electro-mechanical tensioning system.

Example 2. The cable tie application tool of any other example contained herein, wherein the power delivery system includes an electric motor connected to a battery of the cable tie application tool or an external power source.

Example 3. The cable tie application tool of any other example contained herein, wherein the electric motor comprises a brushless motor.

Example 4. The cable tie application tool of any other example contained herein, wherein the electro-mechanical tensioning system includes a drive tube directly connected to the electrical motor.

Example 5. The cable tie application tool of any other example contained herein, wherein the electric motor is configured to rotate the drive tube when activated.

Example 6. The cable tie application tool of any other example contained herein, wherein the electric motor is configured to rotate the drive tube in either a clockwise direction or a counterclockwise direction when activated.

Example 7. The cable tie application tool of any other example contained herein, wherein the electro-mechanical tensioning system further includes a drive nut located at a forward end of the drive tube and configured to rotate with the drive tube.

Example 8. The cable tie application tool of any other example contained herein, wherein the electro-mechanical system further includes an alignment pin configured to secure the drive nut to the forward end of the drive tube.

Example 9. The cable tie application tool of any other example contained herein, wherein the electro-mechanical tensioning system further includes: a pawl assembly; and connected to the pawl assembly, a reciprocating screw including threads configured to engage with threads of the drive nut to prevent rotation of the pawl assembly.

Example 10. The cable tie application tool of any other example contained herein, wherein the reciprocating screw is configured to generate an axial movement of the pawl assembly based on rotation of the drive nut.

Example 11. The cable tie application tool of any other example contained herein, wherein the axial movement comprises forward motion of the pawl assembly based on a forward rotation of the drive nut, and the axial movement comprises rearward motion of the pawl assembly based on a reverse rotation of the drive nut.

Example 12. The cable tie application tool of any other example contained herein, wherein the pawl assembly comprises: a pawl; a gripper attached to the pawl; a torsional spring; and a gripper shaft configured to rotate around the torsional spring to cause the gripper to rotate into engagement with a cable tie.

Example 13. The cable tie application tool of any other example contained herein, wherein the pawl assembly further comprises: a compression spring configured to forward-bias the pawl assembly from the reciprocating screw.

Example 14. The cable tie application tool of any other example contained herein, wherein the gripper is configured to rotate to engage with the cable tie and tighten the cable tie towards the pawl assembly with the particular amount of force.

Example 15. The cable tie application tool of any other example contained herein, wherein the reciprocating screw is configured to generate a reactionary force upon the drive nut as the particular amount of force increases.

Example 16. The cable tie application tool of any other example contained herein, wherein the reciprocating screw is further configured to move in a rearward direction to generate the reactionary force upon the drive nut.

Example 17. The cable tie application tool of any other example contained herein, wherein the drive tube is further configured to create a moment upon a lever by translating the reactionary force through a thrust-washer assembly of the cable tie application tool and into the lever.

Example 18. The cable tie application tool of any other example contained herein, wherein one end of the lever is pivotally attached to the housing, and another end of the lever is connected to a tension rod of the cable tie application tool.

Example 19. The cable tie application tool of any other example contained herein, wherein the drive tube is further configured to create the moment upon the lever by translating the reactionary force through the tension rod in a forward direction opposite the rearward direction.

Example 20. The cable tie application tool of any other example contained herein, wherein the tension rod is configured to distribute the reactionary force throughout a central portion of the tension rod.

Example 21. The cable tie application tool of any other example contained herein, further comprising: a processor configured to determine, based on a reactionary force measured at a central portion of a tension rod of the cable tie application tool, the particular amount of force with which the electro-mechanical tension assembly tightens the cable tie.

Example 22. The cable tie application tool of any other example contained herein, wherein the sensing system comprises one or more load cells that are configured to measure the reactionary force and the processor is further configured to determine the reactionary force using the one or more load cells.

Example 23. The cable tie application tool of any other example contained herein, wherein the sensing system comprises one or more strain gauges that are configured to measure the reactionary force, and the processor is further configured to determine the reactionary force using the one or more strain gauges.

Example 24. The cable tie application tool of any other example contained herein, wherein the sensing system further includes a tension bar attached to the one or more strain gauges, wherein the drive nut is pivotally mounted within the tension bar.

Example 25. The cable tie application tool of any other example contained herein, wherein the processor is further configured to activate an electric motor of the power delivery system when the particular amount of force does not satisfy a preselected tension setting.

Example 26. The cable tie application tool of any other example contained herein, wherein the processor is further configured to deactivate the electric motor when the particular amount of force satisfies the preselected tension setting.

Example 27. The cable tie application tool of any other example contained herein, wherein the processor is further configured to activate the cut-off system when the particular amount of force satisfies the preselected tension setting.

Example 28. The cable tie application tool of any other example contained herein, wherein the cut-off system includes: a cut-off spring; and an actuator configured to be in a loaded condition before the processor activates the cut-off system, the actuator configured to compress the cut-off spring when the actuator is in the loaded condition by applying a rearward pressure.

Example 29. The cable tie application tool of any other example contained herein, wherein the cut-off system further includes a solenoid configured to energize when the cut-off system is activated, the solenoid configured to free the actuator to move rearward to the cut-off spring and into the loaded condition.

Example 30. The cable tie application tool of any other example contained herein, wherein the cut-off system further includes a blade connected to the actuator and configured to cut the cable tie when the actuator moves rearward into the loaded condition.

Example 31. The cable tie application tool of any other example contained herein, wherein the cut-off system further includes a roller configured to traverse down an actuator ramp when the actuator moves rearward into the loaded condition to rotate a link between the actuator and the blade and cut the cable tie.

Example 32. The cable tie application tool of any other example contained herein, wherein the processor is further configured to determine the reactionary force as a difference in pressure from when the actuator is in an unloaded condition to when the actuator moves into the loaded condition.

Example 33. The cable tie application tool of any other example contained herein, wherein the cut-off system includes an electric motor configured to free the actuator to move rearward to the cut-off spring and into the loaded condition.

Example 34. The cable tie application tool of any other example contained herein, wherein the power delivery system further includes a proximity sensor configured to monitor a relative movement of a component of the cable tie application tool to determine the reactionary force.

Example 35. The cable tie application tool of any other example contained herein, wherein the power delivery system further includes a proximity sensor configured to monitor the relative movement by measuring a level of rotation of an armature of the electric motor.

Example 36. The cable tie application tool of any other example contained herein, wherein the proximity sensor is configured to monitor the relative movement by measuring the level of rotation of the armature of the electric motor by counting pulses to and from the electric motor.

Example 37. A method comprising: driving, with a power delivery system included in a housing of a cable tie application tool, an electro-mechanical tensioning system of the cable tie application tool to grab and tighten a cable tie; sensing a particular amount of force with which the cable tie is tightened by the electro-mechanical tensioning system; and activating a cut-off system of the cable tie application tool to cut the cable tie when the particular amount of force satisfies a predetermined setting.

Example 38. A system comprising: means for driving an electro-mechanical tensioning system of a cable tie application tool to grab and tighten a cable tie; means for sensing a particular amount of force with which the cable tie is tightened by the electro-mechanical tensioning system; and means for activating a cut-off system of the cable tie application tool to cut the cable tie when the particular amount of force satisfies a predetermined setting.

While various embodiments of the disclosure are described in the foregoing description and shown in the drawings, it is to be understood that this disclosure is not limited thereto, but may be variously embodied to practice within the scope of the following claims. From the foregoing description, it will be apparent that various changes may be made without departing from the spirit and scope of the disclosure as defined by the following claims.

The use of "or" and grammatically related terms indicates non-exclusive alternatives without limitation, unless the context clearly dictates otherwise. As used herein, a phrase referring to "at least one of" a list of items refers to any combination of those items, including single members. As an example, "at least one of: a, b, or c" is intended to cover a, b, c, a-b, a-c, b-c, and a-b-c, as well as, any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

What is claimed is:

1. A cable tie application tool comprising:

a housing;

a power delivery system included in the housing;

an electro-mechanical tensioning system driven by the power delivery system;

a sensing system configured to sense a particular amount of force with which a cable tie is tightened by the electro-mechanical tensioning system; and a cut-off system configured to cut the cable tie after the cable tie is tightened by the electro-mechanical tensioning system, the cut-off system comprising:

a cut-off spring;

an actuator configured to be positioned in a loaded condition where the actuator compresses the cut-off spring in a first direction; and a blade connected to the actuator, the blade configured to cut the cable tie when the actuator is freed from the loaded condition to move in a second direction based on pressure from the cut-off spring.

2. The cable tie application tool of claim 1, wherein the power delivery system includes an electric motor connected to a battery of the cable tie application tool or an external power source.

3. The cable tie application tool of claim 2, wherein the electro-mechanical tensioning system includes a drive tube directly connected to the electrical motor, and the electric motor is configured to rotate the drive tube when activated.

4. The cable tie application tool of claim 3, wherein the electro-mechanical tensioning system further includes a drive nut located at a forward end of the drive tube and configured to rotate with the drive tube.

5. The cable tie application tool of claim 4, wherein the electro-mechanical tensioning system further includes an alignment pin configured to secure the drive nut to the forward end of the drive tube.

6. The cable tie application tool of claim 4, wherein the electro-mechanical tensioning system further includes:

a pawl assembly; and connected to the pawl assembly, a reciprocating screw including threads configured to engage with threads of the drive nut to prevent rotation of the pawl assembly.

7. The cable tie application tool of claim 6, wherein the reciprocating screw is configured to generate an axial movement of the pawl assembly based on rotation of the drive nut, the axial movement including forward motion of the pawl assembly based on a forward rotation of the drive nut and rearward motion of the pawl assembly based on a reverse rotation of the drive nut.

8. The cable tie application tool of claim 6, wherein the pawl assembly comprises:

a pawl;

a gripper attached to the pawl, wherein the gripper is configured to rotate to engage with the cable tie and tighten the cable tie towards the pawl assembly with the particular amount of force;

a torsional spring; and a gripper shaft configured to rotate around the torsional spring to cause the gripper to rotate into engagement with a cable tie.

9. The cable tie application tool of claim 6, wherein the pawl assembly further comprises:

a compression spring configured to forward-bias the pawl assembly from the reciprocating screw, and the reciprocating screw is configured to generate a reactionary force upon the drive nut due to increases in the particular amount of force.

10. The cable tie application tool of claim 9, wherein the reciprocating screw is further configured to move in a rearward direction to generate the reactionary force upon the drive nut.

11. The cable tie application tool of claim 10, wherein the drive tube is further configured to create a moment upon a lever by translating the reactionary force through a thrust-washer assembly of the cable tie application tool and into the lever.

12. The cable tie application tool of claim 11, wherein one end of the lever is pivotally attached to the housing and another end of the lever is connected to a tension rod of the cable tie application tool, wherein the drive tube is further configured to create the moment upon the lever by translating the reactionary force through the tension rod in a forward direction opposite the rearward direction, wherein the tension rod is configured to distribute the reactionary force throughout a central portion of the tension rod.

13. The cable tie application tool of claim 1, further comprising:

a processor configured to determine, based on a reactionary force measured at a central portion of a tension rod of the cable tie application tool, the particular amount of force with which the electro-mechanical tensioning system tightens the cable tie.

14. The cable tie application tool of claim 13, wherein the sensing system comprises one or more load cells that are configured to measure the reactionary force, and the processor is further configured to determine the reactionary force using the one or more load cells.

15. The cable tie application tool of claim 13, wherein the sensing system comprises one or more strain gauges that are configured to measure the reactionary force, and the processor is further configured to determine the reactionary force using the one or more strain gauges, wherein the sensing system further includes a tension bar attached to the one or more strain gauges, wherein a drive nut is pivotally mounted to the tension bar.

16. The cable tie application tool of claim 13, wherein the processor is further configured to:

activate an electric motor of the power delivery system when the particular amount of force does not satisfy a preselected tension setting; and deactivate the electric motor when the particular amount of force satisfies a preselected tension setting.

17. The cable tie application tool of claim 16, wherein the processor is further configured to activate the cut-off system when the particular amount of force satisfies the preselected tension setting.

18. The cable tie application tool of claim 13, wherein the processor is further configured to determine the reactionary force as a difference in pressure from when the actuator is in an unloaded condition to when the actuator moves into the loaded condition.

19. The cable tie application tool of claim 13, wherein the power delivery system includes an electric motor and a proximity sensor configured to monitor a relative movement of a component of the cable tie application tool to determine the reactionary force by measuring a level of rotation of an armature of the electric motor by counting pulses to and from the electric motor.

20. The cable tie application tool of claim 1, wherein the cut-off system further includes a solenoid configured to energize when the cut-off system is activated, the solenoid configured to free the actuator to move in the second direction.

21. The cable tie application tool of claim 20, wherein the cut-off system further includes a roller configured to traverse down an actuator ramp when the actuator moves in the second direction to rotate a link between the actuator and the blade and cut the cable tie.

22. The cable tie application tool of claim 1, wherein the cut-off system includes an electric motor configured to free the actuator to move in the second direction.

23. The cable tie application tool of claim 1, wherein the first direction is opposite the second direction.

24. A method comprising:

driving, with a power delivery system included in a housing of a cable tie application tool, an electro-mechanical tensioning system of the cable tie application tool to grab and tighten a cable tie;

sensing a particular amount of force with which the cable tie is tightened by the electro-mechanical tensioning system;

configuring an actuator of the cable tie application tool in a loaded condition where the actuator compresses a cut-off spring in a first direction;

locking the actuator in the loaded condition; and activating a cut-off system of the cable tie application tool to free the actuator to move rearward to the cut-off spring in a second direction and cut the cable tie through a blade connected to the actuator when the sensed particular amount of force satisfies a predetermined setting.

25. A system comprising:

means for driving an electro-mechanical tensioning system of a cable tie application tool to grab and tighten a cable tie;

means for sensing a particular amount of force with which the cable tie is tightened by the electro-mechanical tensioning system; and means for activating a cut-off system of the cable tie application tool to cut the cable tie when the particular amount of force satisfies a predetermined setting, the means for activating further comprising:

a cut-off spring;

an actuator configured to be positioned in a loaded condition where the actuator compresses the cut-off spring in a first direction; and a blade connected to the actuator, the blade configured to cut the cable tie when the actuator is freed from the loaded condition to move in a second direction based on pressure from the cut-off spring.

* * * * *